United States Patent [19]

Brennan et al.

[11] Patent Number: 4,641,901

[45] **Date of Patent: * Feb. 10, 1987**

[54] PRINTED CIRCUIT BOARD JACK FOR MODULAR PLUG CONNECTOR TERMINATED CORD

[75] Inventors: Robert J. Brennan, Ossining; Terrence Meighen, Stormville; Walter M. Phillipson, Woodside, all of N.Y.

[73] Assignee: Stewart Stamping Corp., Yonkers, N.Y.

[ * ] Notice: The portion of the term of this patent subsequent to Aug. 27, 2002 has been disclaimed.

[21] Appl. No.: 612,722

[22] Filed: May 21, 1984

Related U.S. Application Data

[63] Continuation-in-part of Ser. No. 570,806, Jan. 16, 1984, Pat. No. 4,537,459.

[51] Int. Cl.[4] ..... H01R 13/658

[52] U.S. Cl. ..... 339/14 R; 339/143 R; 339/176 M

[58] Field of Search ..... 339/143 R, 176 M, 176 MP, 339/DIG. 3, 14 R, 14 P

[56] References Cited

U.S. PATENT DOCUMENTS

| | | | |
|---|---|---|---|
| 4,224,485 | 9/1980 | Krumreich | 339/176 M |
| 4,235,501 | 11/1980 | Ericsson | 339/176 M |
| 4,274,691 | 6/1981 | Abernethy et al. | 339/176 MP |
| 4,423,288 | 12/1983 | Webb | 339/176 M |
| 4,457,575 | 7/1984 | Davis et al. | 339/176 MP |
| 4,497,526 | 2/1985 | Myers | 339/176 M |
| 4,506,944 | 3/1985 | Brennan et al. | 339/143 R |
| 4,516,825 | 5/1985 | Brennan et al. | 339/17 F |
| 4,537,459 | 8/1985 | Brennan et al. | 339/143 R |

*Primary Examiner*—Gil Weidenfeld
*Assistant Examiner*—Gary F. Paumen
*Attorney, Agent, or Firm*—Steinberg & Raskin

[57] ABSTRACT

A jack for modular plug connectors designed for connection to a printed circuit board includes a housing formed of three parts which when interfitted define a receptacle for receiving a modular plug connector which terminates a multi-conductor cord. A plurality of jack contacts are held through the interfitting relationship of the various housing parts in a manner such that the jack contacts are entirely enclosed within the housing except for the projecting portions thereof which are adapted to be inserted into the printed circuit board. The plug receiving receptacle is partially defined by a surface adapted to provide a backing support for the jack contact portions engaged by the contact terminals of the modular plug connector. According to one embodiment, one of the jack housing parts which substantially surrounds the longitudinal extent of the modular plug connector when the latter is inserted into the plug receiving cavity is formed of a material which is electrically conductive and which provides good electromagnetic and radio frequency radiation shielding. In use, a cord shield terminating contact of the modular plug connector may contact one or both of the conductive housing part and a grounded jack contact to ground any electrostatic charge in the cord shield to prevent electrical arcing.

17 Claims, 14 Drawing Figures

PRINTED CIRCUIT BOARD JACK FOR MODULAR PLUG CONNECTOR TERMINATED CORD

This application is a continuation-in-part of application Ser. No. 570,806 filed Jan. 16, 1984, now U.S. Pat. No. 4,573,549.

BACKGROUND OF THE INVENTION

The present invention relates generally to electrical connectors and, more particularly, to a jack for multi-conductor cord terminated by a modular plug connector designed to be connected to a printed circuit board.

The termination of multi-conductor cord by modular plug connectors has become commonplace. Examples of such modular plug connectors are disclosed in patents assigned to Western Electric Company, Inc., such as U.S. Pat. Nos. 3,699,498, 3,761,869, 3,860,316 and 3,954,320. Another advantageous configuration of a modular plug connector is disclosed in U.S. Pat. 4,211,462 assigned to Stewart Stamping Corporation, assignee of the instant application. Essentially, the modular plug connector includes a dielectric housing having a cavity into which an end portion of the cord having exposed conductors is received. Flat contact terminals corresponding in number to the number of cord conductors are inserted into respective slots which open at the housing top so that blade-like portions thereof pierce respective cord conductors with straight upper edges of the contact terminal being exposed at the top of the housing adapted to be engaged by respective jack contacts when the modular plug connector is inserted into the jack.

It is frequently necessary to connect a multi-conductor cord terminated by a modular plug connector to a printed circuit board. In this connection, jacks for modular plug connectors have been designed for connection to a printed circuit board.

In particular, conventional jacks of this type, such as those available from Virginia Plastic Company of Roanoke, Virginia, generally comprise a one-piece plastic housing having a longitudinal cavity opening at the front of the housing adapted to receive the modular plug connector. Associated with the housing are a plurality of jack contacts adapted to engage the straight upper edges of the contact terminals of the plug connector when the latter is inserted into the jack receptacle. Each jack contact is held by slots or grooves formed in the housing and includes a portion which extends along the rear housing wall and projects below the bottom of the housing for insertion into the printed circuit board and a portion which extends through a slot formed through the jack housing top wall into the jack receptacle for engagement with the upper edge of a respective contact terminal of the plug connector.

These jacks are not entirely satisfactory for several reasons. For example, the jack contacts are exposed externally of the jack both at the rear as well as at the top wall thereof thus subjecting the contacts to possible damage during use. Moreover, the jack contacts tend to be pushed out or at least become loosened from the slots or grooves which hold them in place due to repeated engagement by the upper edges of the plug connector contact terminals resulting in an unreliable contact engagement. Still further, the jack contacts require several reverse bending operations in manufacture thereby increasing the cost of manufacture of the jack.

Conventional jacks for modular plug connectors designed for connection to a printed circuit board are not completely satisfactory for another reason. Thus, digital-based electronic equipment is a major source of electromagnetic (EMI) and radio frequency (RFI) interference. Such interference has become a problem at least in part due to the movement away from metal and towards plastics as the material from which connector housings are formed. Plastics generally lack the shielding effectiveness inherent in metal housings.

In order to prevent or at least substantially control the emission of interference-causing electromagnetic and radio frequency radiation from multi-conductor cords used in digital-based electronic equipment and to provide at least some protection from interferencecausing signals radiated from external equipment, cords have conventionally be provided with "shielding" in the form of a continuous sheath of conductive material between the outer insulation jacket of the cord and the insulated conductors, the shield surrounding and enclosing the conductors along their length. The shield can be formed of any suitable conductive material such, for example, as thin Mylar having a surface coated with aluminum foil. The shield acts to suppress or contain the interference-causing electromagnetic and radio frequency signals radiating outwardly from the cord conductors and, conversely, to prevent such high frequency signals generated by external equipment from causing interference in the conductors. The shields have conventionally been grounded either by means of a socalled "drain wire" which extends through the cord in electrical engagement with the conductive shield, the end of the drain wire passing out of the connector to be grounded, or by grounding the shield through one of the modular plug connector contacts.

However, these techniques have not satisfactorily eliminated the interference problem and have created additional problems. Specifically, it has been found that there is still a tendency for EMI and RFI to result from the leakage of electromagnetic and radio frequency radiation signals from the cord in the region at which the modular plug connector is inserted into the jack receptacle. Moreover, it is not uncommon for high frequency signals radiated from nearby equipment to pass through the jack and cause interference in the cord conductors.

Furthermore, the radiation shield tends to acquire an electrostatic charge over a period of time. When the radiation shield is grounded using conventional techniques, such as through one of the modular plug connector contacts, it is not uncommon for electrical discharge arcs to occur across the connector contacts or across the printed circuit board conductors. Such arcing can cause serious damage to the electrical equipment.

For these reasons, it has been proposed to modify the modular plug connector by incorporating a shield terminating contact pin as part of the connector itself. In particular, it has been proposed to provide a pin-shaped contact formed of electrically conductive material through a passage formed in a side wall of the modular plug connector so that one end of the contact is exposed externally at one side of the dielectric plug connector housing while a portion of the length of the contact pin electrically engages a region of the foil shield surrounding the conductors. It has been further proposed that a conventional jack be provided with a grounded contact specifically adapted to engage the exposed end of the shield terminating contact pin of the modular plug connector upon its insertion into the jack receptacle to both ground any electrostatic charge in the shield and to conduct the electromagnetic and radio frequency signals carried in the shield to ground thereby preventing leakage of radiation from the connector. In this connection, reference is made to U.S. Pat. Nos. 4,516,825 issued May 14, 1985 and 4,506,944 issued Mar. 26, 1985 and parent application Ser. No. 570,806 filed Jan. 16, 1984, now U.S. Pat. No. 4,537,459, said patents. being assigned to the same assignee as the instant application.

It will be understood that it is desirable to provide a jack for modular plug connectors of the type described above, namely, a plug connector which incorporates a shield terminating contact, which is provided with means for reliably grounding the cord shield through the shield terminating contact of the plug connector upon insertion of the connector into the jack. Moreover, it is also desirable to at the same time provide the jack with effective EMI/RFI shielding characteristics for the modular plug connector itself to suitably attenuate any radiation which may either leak from the region of the connector or be generated by external equipment.

SUMMARY OF THE INVENTION

Accordingly, it is an object of the present invention to provide a new and improved jack for modular plug connectors designed for connection to a printed circuit board which overcomes the disadvantages of conventional jacks of this type.

It is another object of the present invention to provide a new and improved printed circuit board jack for modular plug connectors which provides reliable electrical contact with the contact terminals of a modular plug connector over long periods of use.

Still another object of the present invention is to provide a new and improved printed circuit board jack for modular connectors of the type which incorporate a radiation shield terminating contact pin and which includes means for reliably grounding the cord shield through a shield terminating contact of the connector to prevent high frequency emissions and possible arcing due to an electrostatic charge in the radiation shield.

A further object of the present invention is to provide a new and improved printed circuit board jack for modular plug connectors which itself provides effective EMI/RFI shielding for the connector to attenuate any radiation passing into and out of the jack.

Yet another object of the present invention is to provide a new and improved printed circuit board jack for modular plug connectors which is simple in construction, economic in manufacture and reliable in operation.

Briefly, in accordance with the present invention, these and other objects are attained by providing a jack for modular plug connectors designed for connection to a printed circuit board which includes a housing formed of three parts which when interfitted define a cavity or receptacle for receiving a modular plug connector which terminates a multi-conductor cord. A plurality of jack contacts are reliably held through the interfitting relationship of the various jack parts in a manner such that the jack contacts are entirely enclosed within the housing except for the projecting portions thereof which are adapted to be inserted into the printed circuit board. The plug receiving cavity is partially defined by a surface adapted to provide a backing support for the jack contact portions which are engaged by the contact terminals of the modular plug connector.

One of the jack housing parts substantially surrounds the longitudinal extent of the modular plug connector when the latter is inserted into the plug receiving cavity and is formed of a material which is electrically conductive and which provides good EMI/RFI shielding to thereby attenuate any electromagnetic and radio frequency radiation passing out from or into the jack receptacle. In the case where the modular plug connector is provided with a cord shield terminating contact, a grounded jack contact may be provided which is adapted to engage the connector contact pin to ground the shield. Moreover, in addition or alternatively, the jack may be designed such that the shield terminating contact engages the conductive material of the jack housing part to ground the shield upon insertion of the modular plug connector. In this manner electrostatic arcing is reliably prevented. The other jack contacts are maintained electrically isolated from the conductive jack shielding part at all times. Other details of the invention will be apparent from the following description.

DETAILED DESCRIPTION OF THE DRAWINGS

A more complete appreciation of the presention invention and many of the attendant advantages thereof will be readily understood by reference to the following detailed description when considered in connection with the accompanying drawings in which.

DESCRIPTION OF THE PREFERRED EMBODIMENTS

Figure 1:
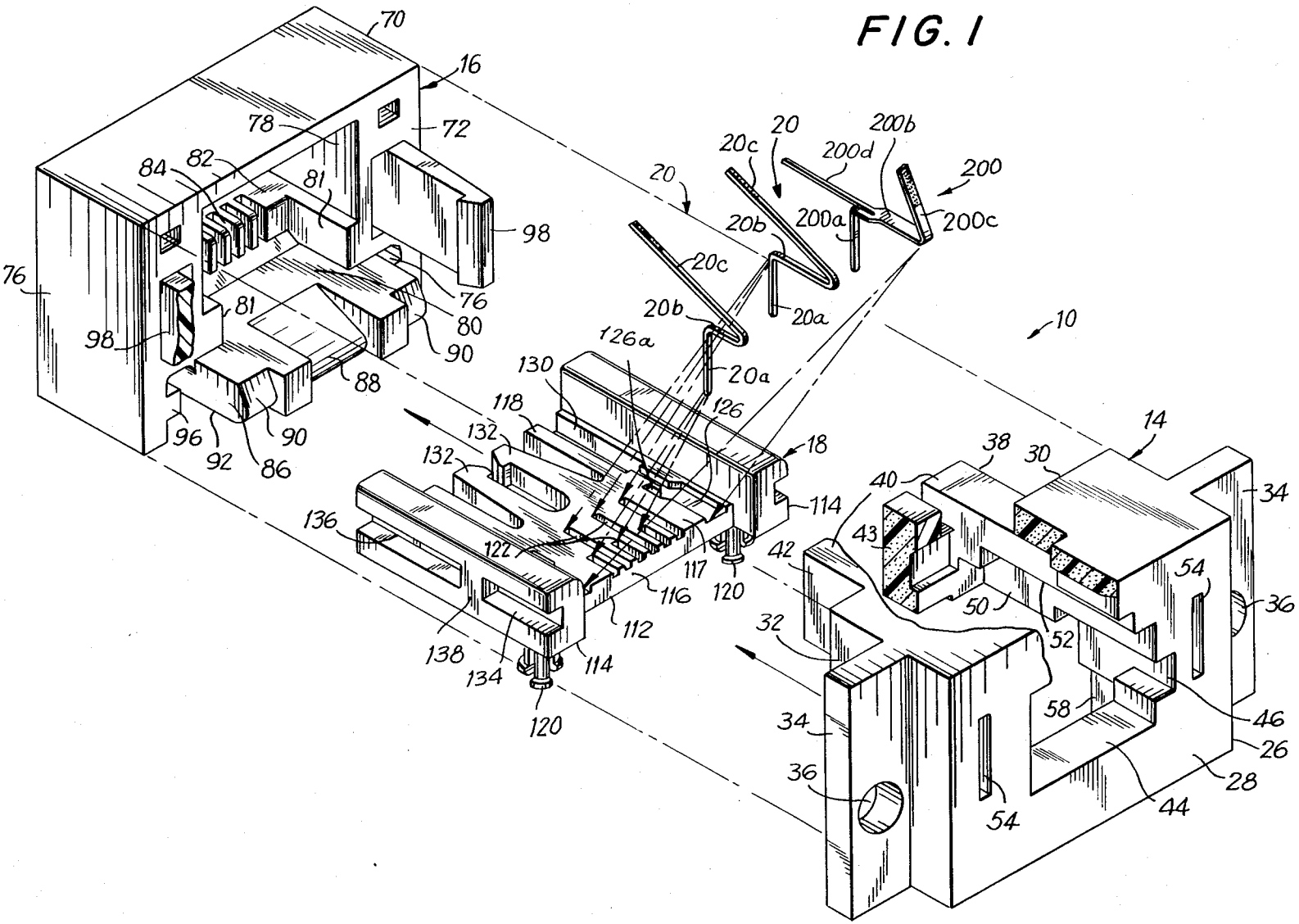
FIG. 1 is an exploded perspective view illustrating the various components of a jack in accordance with the present invention.

Referring now to the drawings wherein like reference characters designate identical or corresponding parts throughout the several views, a first embodiment of a jack according to the present invention, generally designated 10, is illustrated in FIGS. 1–9. Referring to FIGS. 1 and 4–8, jack 10 comprises a housing 12 constructed of three parts, namely, front part 14, rear part 16 and bottom part 18, in which a plurality of jack contacts 20 are provided. The jack parts 14, 16 and 18 are lockingly interfitted as described below to define a cavity or receptacle 22 (FIGS. 4, 6 and 7) for receiving a modular plug connector 24 (FIG. 7) and to reliably hold the jack contacts 20 so that they are entirely enclosed within the housing 12 except for downwardly projecting portions 20*a* (FIG. 7) which are inserted into the printed circuit board.

Figure 3:
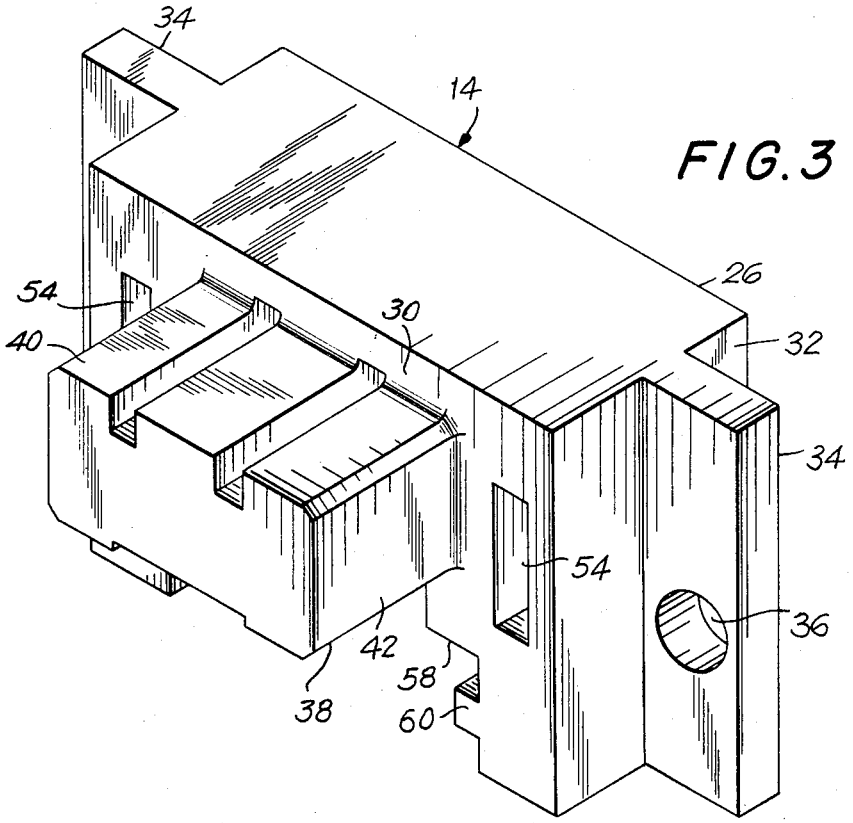
FIG. 3 is a perspective view of the front part of the jack of FIG. 1 as viewed from the rear.
Figure 4:
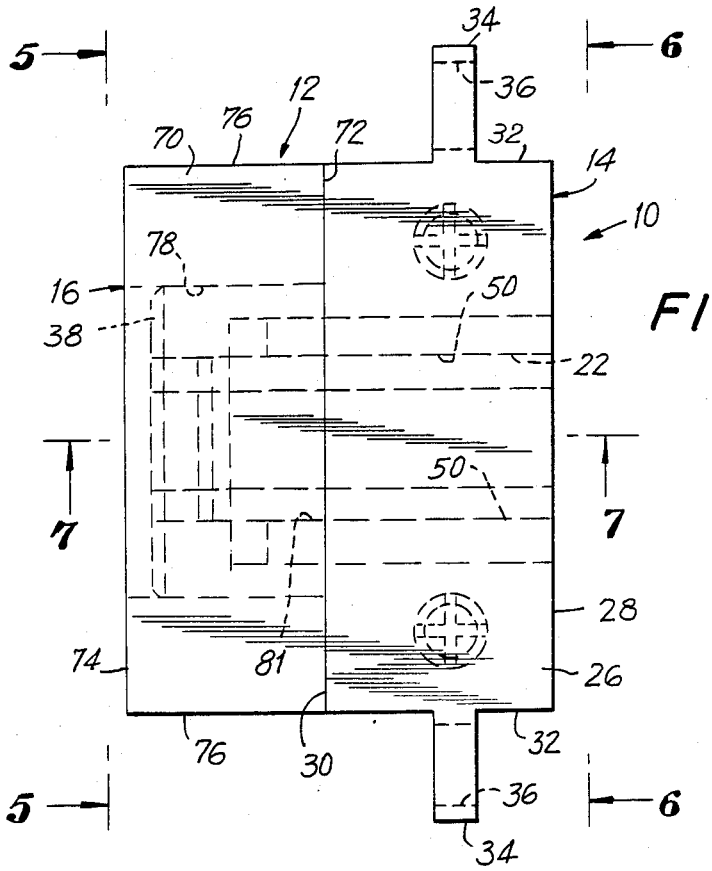
FIG. 4 is a top plan view of the jack of FIG. 1.
Figure 9:
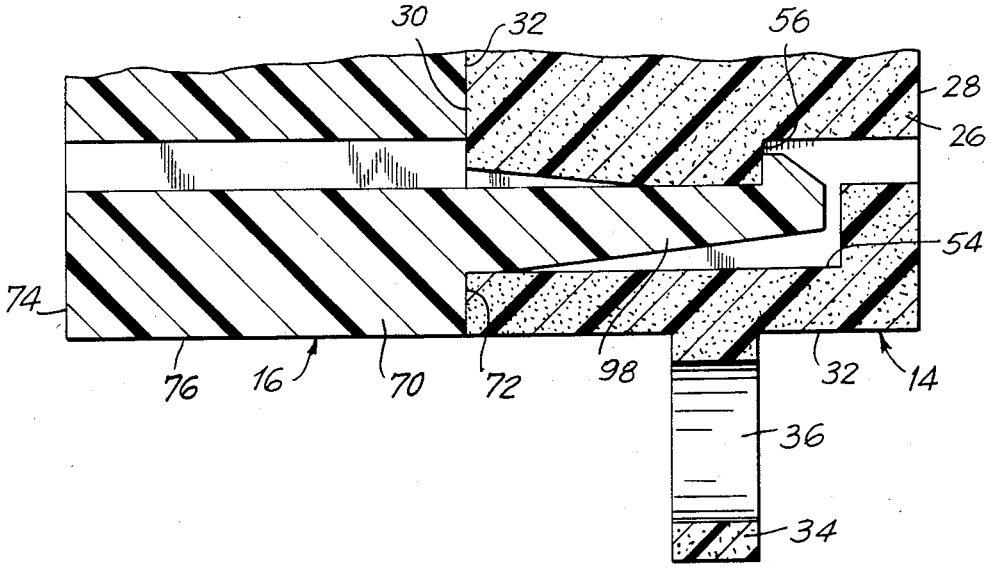
FIG. 9 is a section view taken along line 9—9 of FIG. 6.

Front part 14, best seen in FIGS. 1 and 3, is preferably molded of a material which is electrically conductive and which provides good EMI/RFI shielding, such as ABS with an aluminum flake filling or an alloy resin available from Mobay Chemical Corp. of Pittsburgh, Pennsylvania under the trademark Bayblend. Alternatively, the front part can be manufactured as a zinc die casting. Front part 14 includes a block portion 26 having a front face 28, a rear face 30 and side faces 32. Mounting flanges 34 having mounting openings 36 extend from the side faces 32. A frame portion 38 having a top wall 40, side walls 42, rear wall 43 and an open bottom projects outwardly from the rear face 30 of block portion 26. A rectangular opening 44 (FIG. 1) is formed in block portion 26 through which the modular plug connector 24 is inserted into the jack receptacle 22. A slot 46 is provided to accommodate a contact pin 48 of the modular plug connector which terminates the EMI/RFI cord shield. Inwardly facing side and top faces 50 and 52 extend through the block and frame portions 26 and 38 which partially define the plug receiving jack receptacle 22. A pair of slots 54 are formed through the block portion 26 and as best seen in FIG. 9, each slot 54 has a forwardly facing shoulder 56 formed therein. Referring to FIG. 3, a deep recess 58 is formed in the lower region of block portion 26 from rear face 30 opening through the bottom and a pair of ribs 60 project inwardly from the respective inwardly facing side faces of recess 78.

Figure 2:
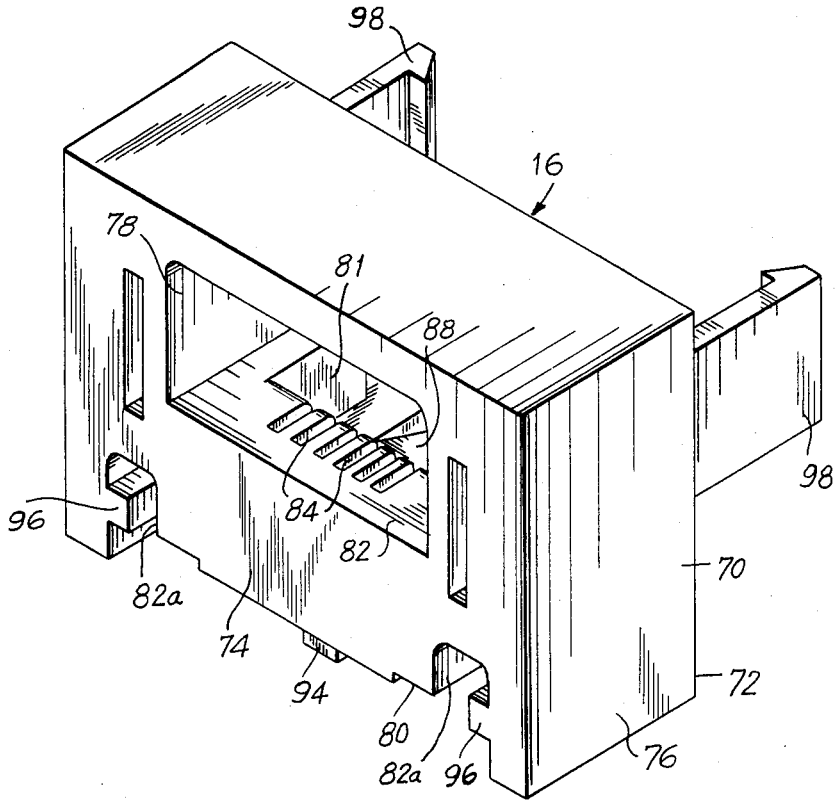
FIG. 2 is a perspective view of the rear part of the jack illustrated in FIG. 1 as seen from the rear.

Rear part 16, best seen in FIGS. 1 and 2, is preferably molded of any suitable dielectric plastic material, such as ABS, and includes a block portion 70 having a front face 72, rear face 74 and side faces 76. An opening 78 is formed through block portion 70 opening at the front and rear faces 72 and 74 adapted to receive the frame portion 38 of front part 14 as described below. A deep cavity 80 is formed in block portion 70 opening onto the front face 72 thereof defining inwardly facing side faces 81 which are coplanar with respective side faces 50 of front part 14 when the jack is assembled as described below. The cavity terminates at a rear wall 82 in which a plurality of equally spaced slots 84 are formed. The rear wall terminates somewhat above the lower edges of side faces 76 and has lateral edges 82*a* which are spaced from respective side walls of block portion 16 as seen in FIG. 2.

A contact backing portion 86 projects forwardly from the lower region of rear wall 82 and extends forwardly beyond the front face 72 of block portion 70. Contact backing portion 86 is formed with a central downwardly sloping contact backing surface 88, a pair of outer downwardly sloping contact backing surfaces 90 and a planar bottom surface 92. A post 94 projects downwardly from bottom surface 92. A pair of ribs 96 project inwardly from the respective inwardly facing side faces of cavity 80 and a pair of latching members 98 project forwardly from the front face 72 of block portion 70 which are adapted to be received in the slots 54 of front part 14 to latch to shoulder 56 as described below.

Figure 8:
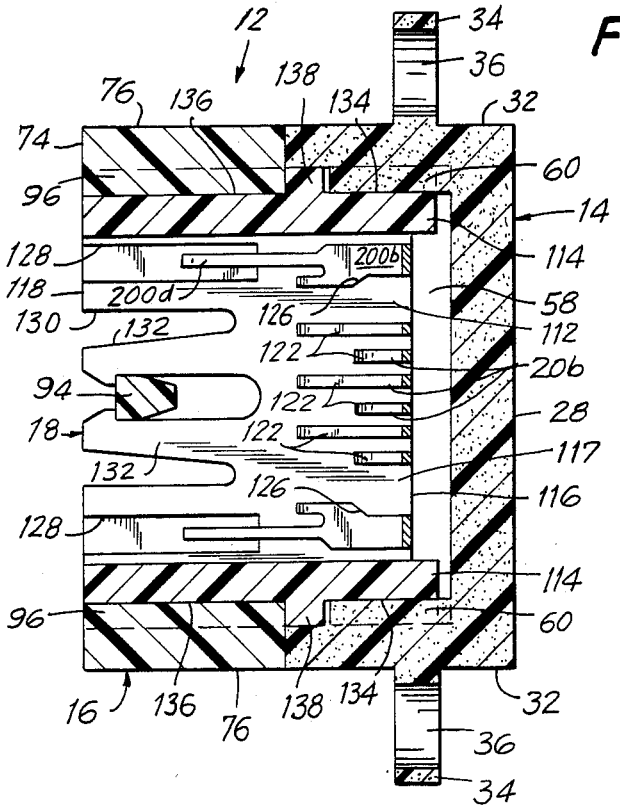
FIG. 8 is a section view taken along line 8—8 of FIG. 7.

Bottom part 18, best seen in FIGS. 1 and 8, is preferably molded of a suitable dielectric plastic material, such as ABS, and includes a substantially planar bottom portion 112 and a pair of enlarged rail portions 114 formed on the lateral sides of bottom portion 112. Bottom portion 112 has a front face 116, a top face 117, a rear face 118 and a bottom face 119 from which a pair of fastening posts 120 project downwardly for physically connecting the jack to a printed circuit board.

A plurality of parallel grooves 122 (six shown) are formed in the top face 117 of bottom portion 112 for receiving the jack contacts as described below. Each groove 122 opens onto the front face 116 and terminates at its rearward end in a bore 124 (FIG. 7) which passes through the bottom portion 112 and through which a portion of a respective jack contact passes for connection to the printed circuit board. Alternate grooves have equal lengths with one set of alternate grooves being shorter than the other set of alternate grooves according to the configuration of the printed circuit board. A pair of enlarged grooves 126 are formed in the top face 117 at the lateral edge regions thereof which open onto the front face 116. The grooves 126, which are adapted to receive jack contacts 200 designed to contact the shield terminating contact pin 48 of the modular plug connector as described below, differ from grooves 122 in that each separates at its rearward end into a pair of groove branches 126*a* and 126*b*. Each groove branch 126*a* continues in a rearward direction and opens into a respective, relatively deep channel 128 formed in top face 117 which opens onto the rear face 118. Each groove branch 126*b* terminates at its rearward end in a bore 130 which passes through bottom portion 112.

A rearwardly opening large recess 130 is formed in the bottom portion 112 in which a pair of opposed rearwardly projecting latching members 132 are accommodated which lock onto post 94 upon assembly. A pair of forwardly and reawardly opening channels 134 and 136 separated by an intermediate wall 138 are formed in each of the rail portions 114.

Referring to FIG. 1, each jack contact 20, when formed during assembly of the jack as described below, includes a downwardly extending portion 20*a* which is adapted to pass through a respective bore 124 and project below the bottom face 119 of bottom part 18 for connection to the printed circuit board, a forwardly extending portion 20*b* forming a substantially right angle with portion 20*a* and which is adapted to be received in a respective groove 122, and an obliquely extending portion 20*c* which is adapted to engage the contact terminals of the modular plug connector.

Figure 7:
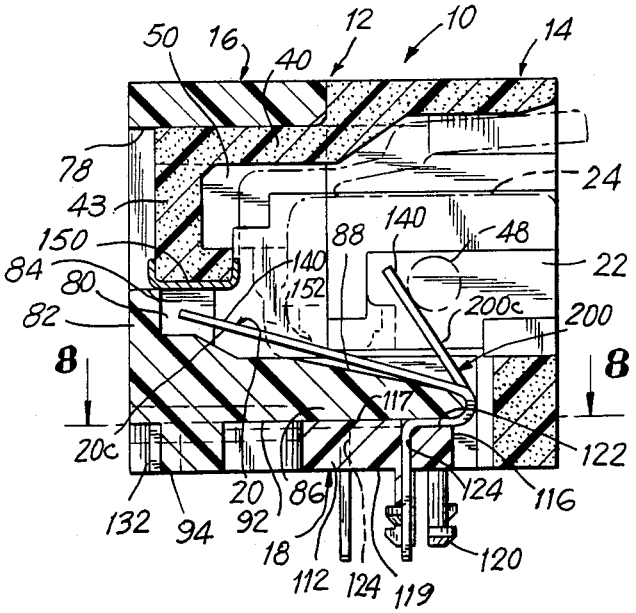
FIG. 7 is a section view of the jack of FIG. 1 taken along line 7—7 of FIG. 4 and wherein a modular plug connector is shown in phantom being inserted into the jack receptacle.
Figure 5:
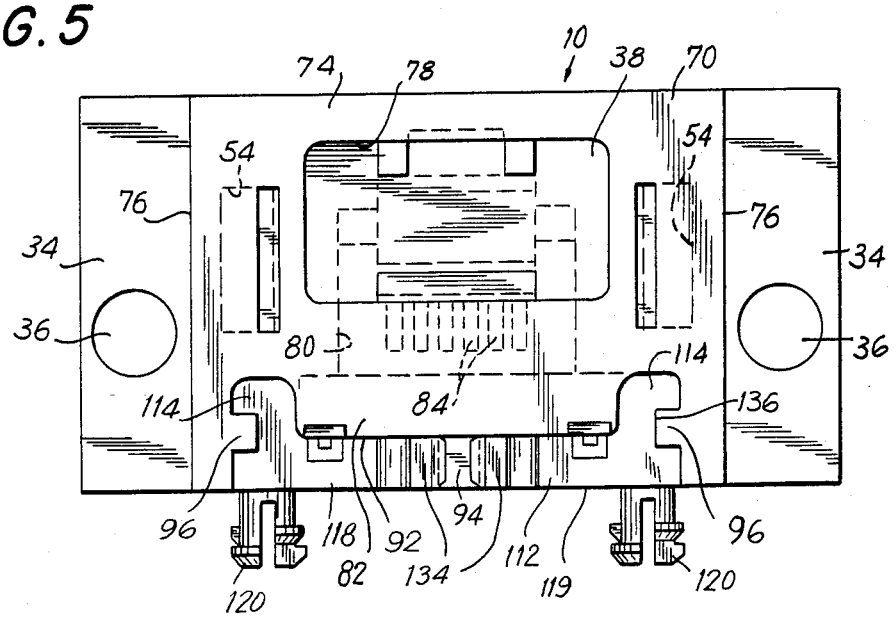
FIG. 5 is a rear elevation view of the jack of FIG. 1 taken in the direction of line 5—5 of FIG. 4.
Figure 6:
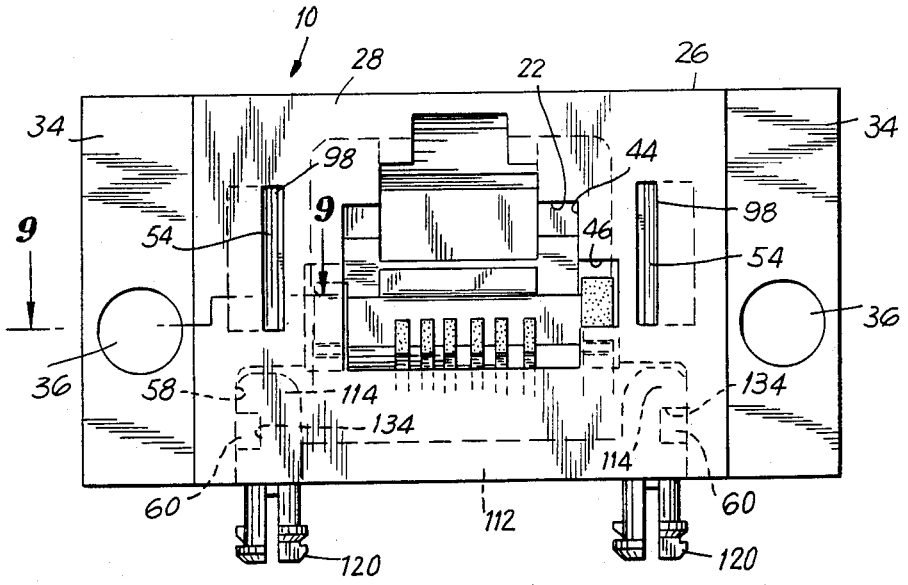
FIG. 6 is a front elevation view of the jack of FIG. 1 as viewed in the direction of line 6—6 of FIG. 4.

Each contact is formed of suitable conductive sheet metal such as phosphor bronze which is sized to appropriate thickness. The regions 40 which are situated so as to be contacted by the flat contact terminals of the modular plug connector are preferably provided with a coating of gold (FIG. 7). Moreover, the contacts are preferably formed with a slight bowing so that the gold coated regions 140 of the contacts engage the contact terminals of the modular plug connector with a line contact providing a more reliable electrical engagement.

In the case where the modular plug connector is provided with a shield terminating contact 48, a contact 200 may be provided at the appropriate side of the jack receptacle depending upon the side of the modular plug connector at which the shield terminating contact pin is situated. The contact 200 is similar to contacts 20 except that portions 200*b* and 200*c* are substantially wider than the corresponding portions 20*b* and 20*c* of contacts 20. Moreover, in addition to a downwardly extending portion 200*a* adapted to be connected to ground through the printed board to drain EMI/RFI radiation and to prevent arcing, an additional rearward extending portion 200*d* is provided adapted to project into a channel 128 for connection to ground through the chassis of the housing in which the printed circuit board is mounted.

In assembly, the plurality of contacts 20 are stamped from a flat sheet material and each is pre-formed so that a portion 20*a* forms a right angle to the remainder of the contact. The contact portion 20*a* of each contact is inserted into a respective bore 124 of bottom part 18 with the unformed remainder of the contact lying in and projecting beyond a respective groove 122. A ground contact 200 is similarly situated in an enlarged groove 126 with a contact portion 200*d* extending rearwardly into a channel 128 as seen in FIG. 8. Bottom part 18 is then assembled to rear part 16 by inserting ribs 96 of the rear part 16 into the channels 136 and sliding the bottom part rearwardly until the front face of ribs 96 abut against the intermediate wall 138. During insertion, the latching members 132 engage post 94 which is beveled to thereby urge the latching members apart until insertion is completed whereupon the barbs of the latching members snap over the post to fix rear part 16 to bottom part 18. During the connection of the bottom and rear parts, the planar bottom surface 92 of contact backing portion 86 covers the grooves 122 and 126 to fix the contacts 20 and 200 in place. The contacts 20 are then bent around the forward end of the central contact backing portion 88 to form contact portions 20*c*. The ground contact 200 is similarly bent aroung the forward end of outer contact backing portion 90 to form contact portion 200*c*.

The front part 14 is then connected to the assembly of the rear and bottom parts 16 and 18. However, when the front part 14 is formed of a conductive shielding material, such as aluminum flake filled plastic or as a zinc die casting, an insulating plastic piece 150 (FIG. 7) is applied over the lower surface of rear wall 43 of the frame portion 38 of the front part. The assembly of the rear and bottom parts 16 and 18 is connected to front part 18 by inserting ribs 60 into the channels 134 until the rear faces of ribs 60 abut the intermediate wall 138. During insertion, the frame portion 38 is received within the opening 78 of the rear part 16 and latching members 98 of the rear part 16 pass into slots 54 of front piece 14. Upon completion of the insertion, the barbs of the latching members snap over shoulder 56 (FIG. 9) to complete the assembly. In its finished form, each of contacts 20 are received in a respective slot 84. Moreover, the free end of contact portions 20*c* press against the insulation piece 150. The contact portion 200*a* extends upwardly at a somewhat greater angle as seen in FIG. 7.

It is seen that the contacts 20 and 200 are fully enclosed within the housing formed by front, rear and bottom parts 14, 16 and 18 with no portions thereof except for connecting portions 20*a* and 200*a* being externally exposed. The contacts are firmly held in position in grooves 122 and 126 by the bottom face 92 of backing portion 86. Moreover, the contacts are reliably isolated from engagement with the front part 14 which may be formed of a conductive shielding material.

In operation, referring to FIG. 7, a modular plug connector 24 is inserted into the jack cavity defined by the inwardly facing side faces 50 and 81, the downwardly facing face of top wall 40 and the contact backing surfaces 88 and 90. As the modular plug connector is inserted the flat contact terminals 152 each engage a respective contact portion 20*c* to flex the latter downwardly. Similarly, the shield terminating contact 48 engages at least one of the contact portion 200*c* of ground contact 200 or the surface of the wall of front part defining slot 46 to ground the EMI/RFI cord shield either through contact portion 200 or through the jack housing front part 14. In this manner electrostatic discharge arcing is reliably prevented. It is seen that when the modular plug connector is fully inserted it is substantially surrounded by the wall of frame portion 38 formed of shielding material thereby effectively shielding the plug from EMI/RFI causing radiation from external equipment and conversely shielding the external environment from any radiation emanating from the modular plug connector.

Referring now to FIGS. 10–14, a second embodiment of a printed circuit board jack for a modular plug connector, generally designated 210, is illustrated. Jack 210 comprises a housing 212 constructed of three parts, namely front part 214, rear part 216 and intermediate part 218, and a plurality of contacts 220. The jack parts 214, 216 and 218 are lockingly interfitted as described below to define a cavity or receptacle 222 (FIGS. 12 and 13) for receiving a modular plug connector having flat contact terminals 224 (FIG. 13) and to reliably hold the jack contacts 220 so that they are entirely enclosed within the housing 212 except for downwardly projecting portions 220*a* (FIGS. 1, 12 and 13) which are inserted into the printed circuit board.

Front part 214 comprises a block portion 226 having front and rear faces 228 and 230, side faces 232 and top and bottom faces 234 and 236. A deep cavity 238 is formed in block portion 226 opening at front face 228 and communicating with rear face 230 through an opening 240. Upwardly facing shoulders 242 extend inwardly from cavity side faces 244 which terminate at forwardly facing shoulders 246 which extend inwardly from cavity rear face 248. Inwardly projecting flanges 250 (FIG. 13) define the inlet opening to cavity 222.

A series of downwardly opening parallel grooves 252 are formed in the inwardly facing cavity top face 254 and extend substantially from the forward end of the cavity to the rear face 230 of block portion 226. A pair of guide fingers 256 and a latching member 258 project from the rear face 230 of the block portion while a pair of posts 260 project downwardly from bottom face 236 for fastening the assembly jack to a printed circuit board. The cavity 222 substantially comprises the jack receptacle in which a modular plug connector is received.

Upon assembly of the jack, described below, the modular plug connector is received within cavity 238 which, together with a contact backing portion of intermediate part 218, described below, defines the jack receptacle 222. Shoulders 242 support the modular plug connector along its bottom edge regions.

Figure 10:
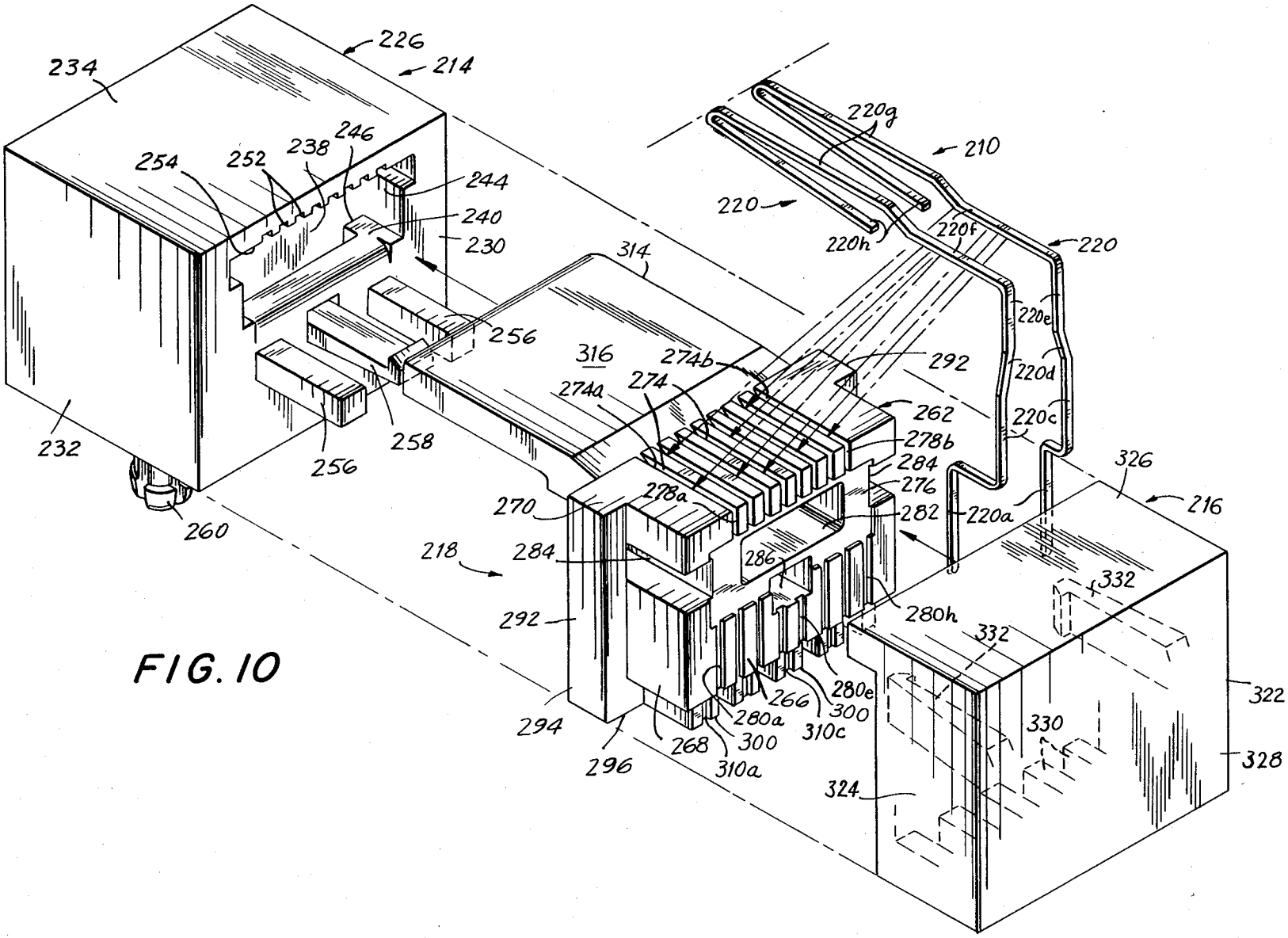
FIG. 10 is an exploded perspective view of a second embodiment of a jack in accordance with the present invention.
Figure 11:
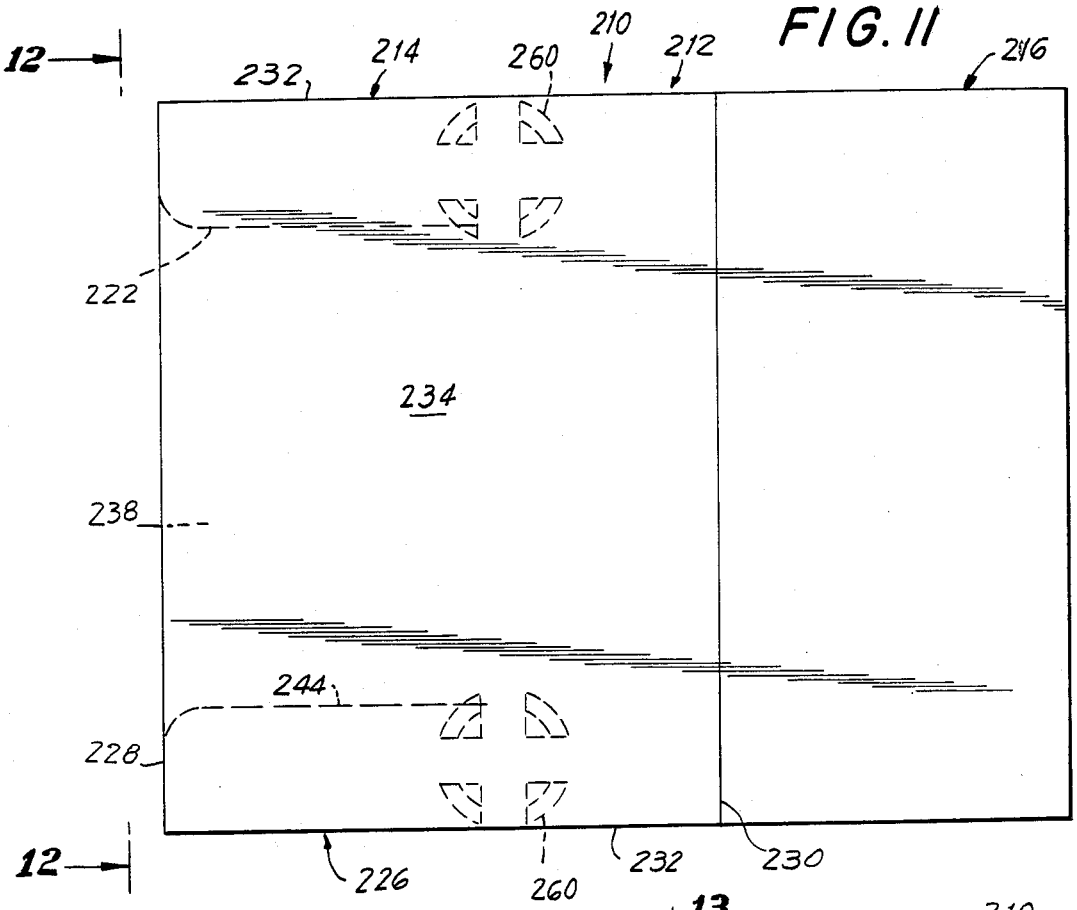
FIG. 11 is a top plan view of the jack of FIG. 10.
Figure 12:
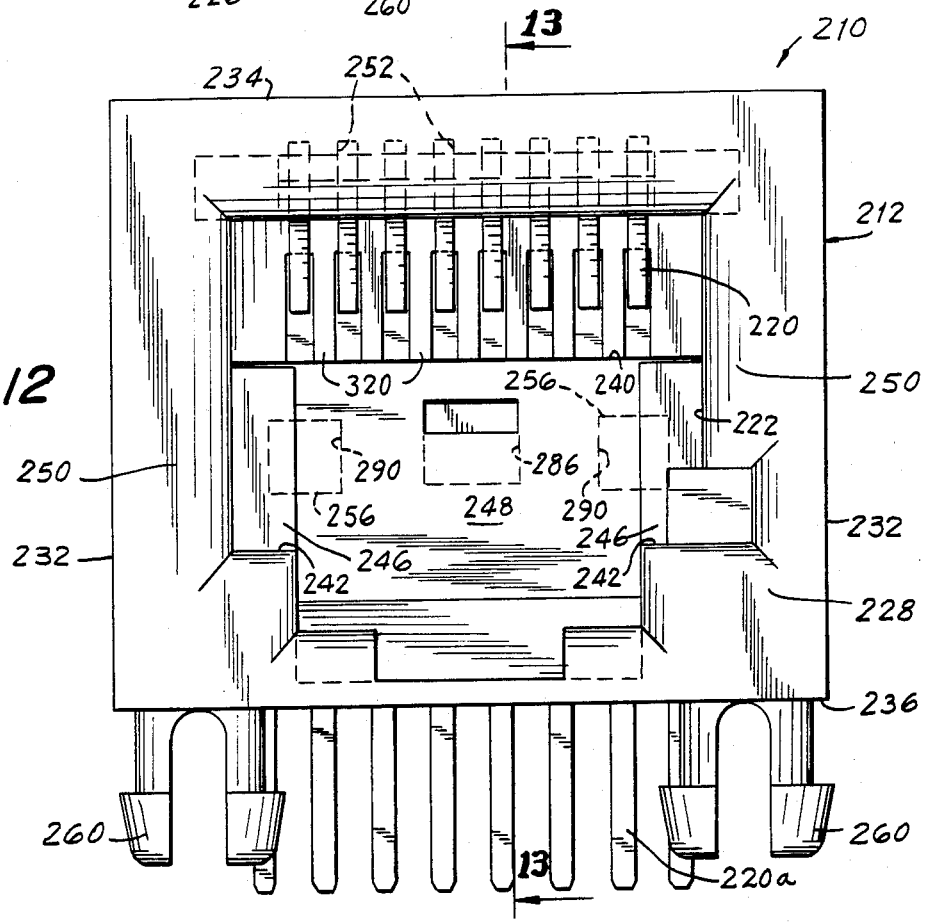
FIG. 12 is a front elevation view of the jack of FIG. 1 taken in the direction of line 12—12 of FIG. 11.

Intermediate part 218 includes a block portion 262 having front and rear faces 264 and 266, side faces 268 and top and bottom faces 270 and 272. A plurality of parallel, top grooves 274 (eight grooves 274*a*–274*h* shown) are formed in top face 270 and are adapted to align with corresponding grooves 252 of front part 214 upon assembly of the jack. A central shallow recess 276 is formed in rear face 266 and the top grooves 274*a*–274*h* communicate with corresponding upper rear grooves 278*a*–*278h* formed above recess 276 in rear face 266 which extend from the top face 270 into recess 276 as best seen in FIG. 10. A corresponding plurality of lower rear grooves 280*a*–280*h* are formed in rear face 266 below recess 276 which extend from recess 276 into the bottom face 272 of block portion 262. As is apparent from FIGS. 10 and 14, the inter-groove spacing between lower grooves 280 is greater than that between upper grooves 278.

Figure 13:
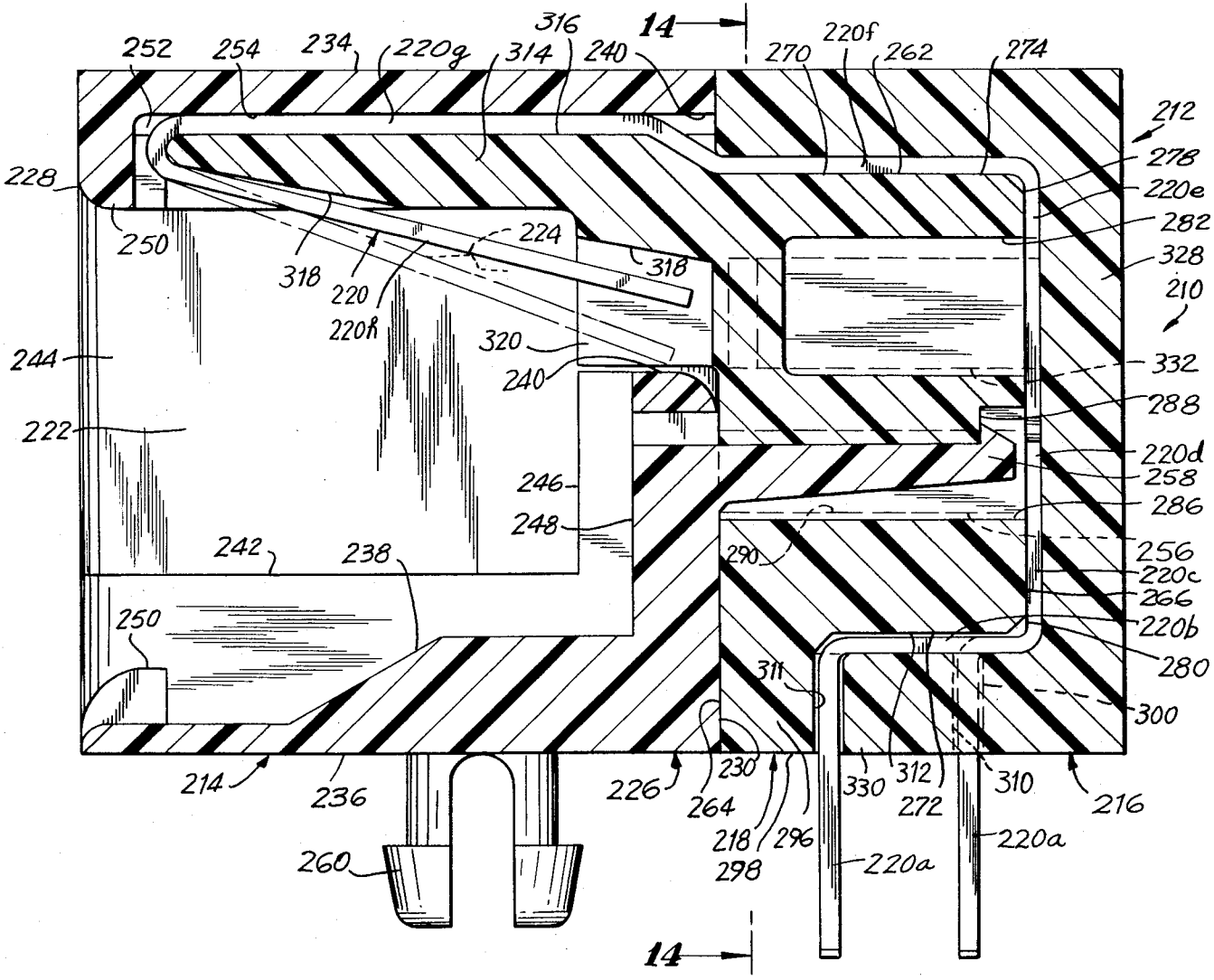
FIG. 13 is a section view taken along line 13—13 of FIG. 12.
Figure 14:
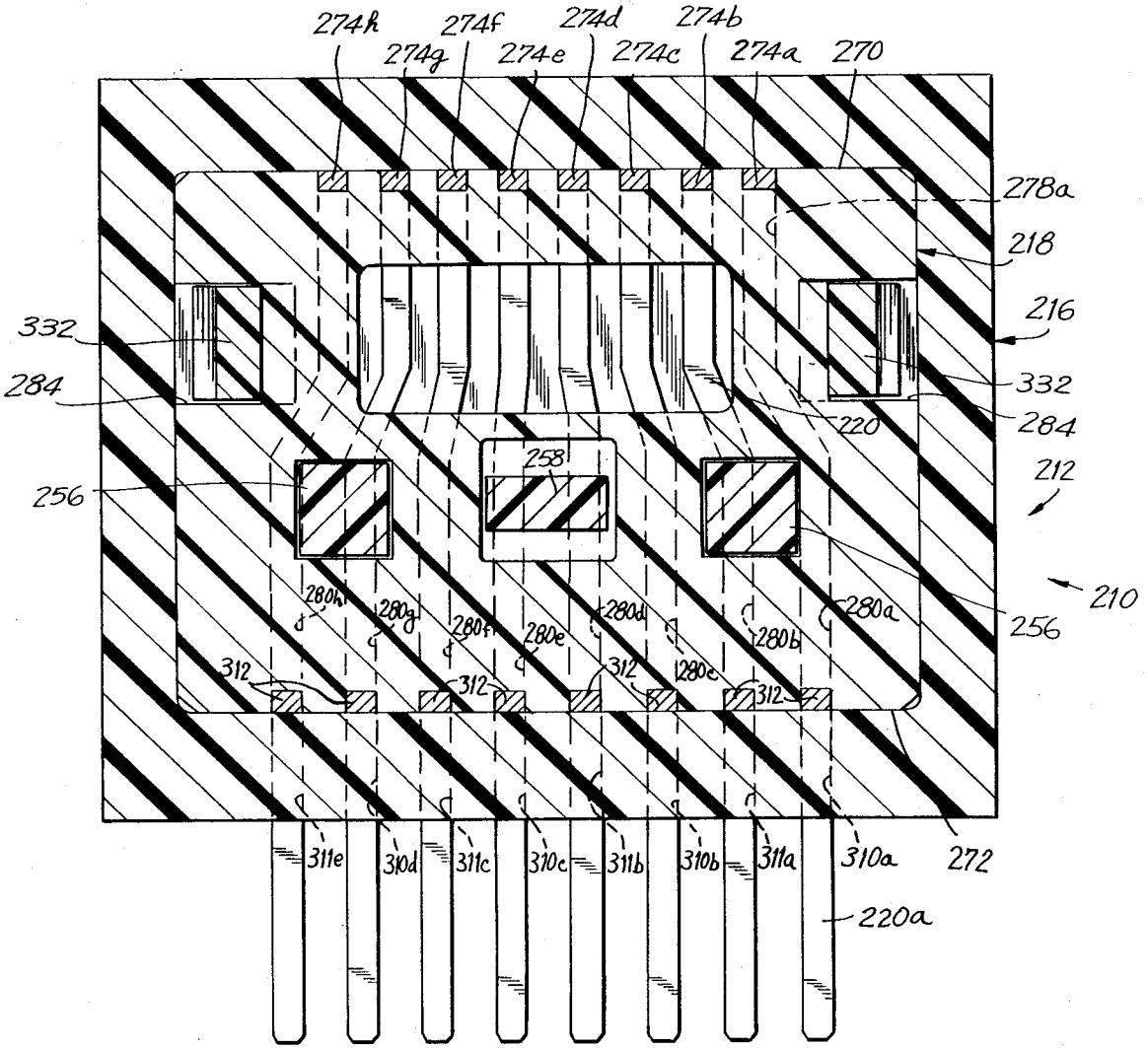
FIG. 14 is a section view taken along line 14—14 of FIG. 13.

A cavity 282 is formed in block portion 268 opening onto the recessed portion of rear face 266. A pair of longitudinal slots 284 are formed in the sides of block portion 268 opening at the front face 264 and a central opening 286 is formed through the block portion opening at the front and rear faces 264 and 266 adapted to receive latching members 258. A rearwardly facing shoulder 288 is provided in opening 286 as best seen in FIG. 13. A pair of blind guide openings 290 are formed in the block portion opening at front face 264 as best seen in FIG. 14.

A pair of flanges 292 project laterally from the side faces 268 of block portion 262. Each flange has a side surface 294 adapted to lie flush with side surface 232 of front part 214 and projects downwardly beyond the bottom face 272 of the block portion. A lower flange 296 (FIG. 14) projects from the bottom face 272 and has a bottom face 298 adapted to lie flush with bottom face 236 of front part 214.

A series of spaced fingers 300 (four in the illustrated embodiment) project rearwardly from lower flange 296 terminating in rear surfaces which lie in a plane situated somewhat forwardly of the rear face 266. A groove 310 is formed in the rear surface of each finger 300 with grooves 310 being situated in alignment with alternating ones of the lower rear grooves 280. Thus, referring to FIG. 14, grooves 310*a, b, c* and *d* are aligned with grooves 280*a, c, e* and *g*. Vertical grooves 310 (FIG. 14) are formed in lower flange 296 between fingers 300 and are in alignment with the other of the alternating grooves 280. Thus, grooves 280*b, d, f, h* are aligned with grooves 311*a, b, c* and *d*. Finally, connecting grooves 312 formed in bottom face 272 interconnect alternating ones of grooves 280 with grooves 310 and 311.

A contact backing portion 314 projects forwardly from front face 264 and as best seen in FIG. 13 is formed with a planar top face 316 and an obliquely extending contact backing face 318. A plurality of walls 320 projecting from front face 264 in the region where contact backing portion 314 joins block portion 262 form slots in which the free ends of respective contacts 220 are situated.

Rear part 216 comprises a block portion 322 having side walls 324, a top wall 326 and a rear wall 328. Projecting forwardly from the bottom of rear wall 328 is a series of fingers 330 situated so as to interdigitate with fingers 300 of intermediate part 218 upon assembly of the jack. A pair of latching members 332 project forwardly from the rear wall 328 adapted to pass through slots 284 of intermediate part 218 upon assembly of the jack.

Each contact 220 includes the portion 220*a* which upon assembly projects below the jack and into one of the grooves 310 or 311, a portion 220*b* adapted to be received in a connecting groove 312, a portion 220*c* adapted to be received in a groove 280, an angled portion 220*d* which extends over the shell or recess 276, a portion 220*e* adapted to be received in a groove 278, a portion 220*f* adapted to be received in a groove 274, a portion 220*g* adapted to be received in a groove 252 and an oblique portion 220*h* adapted to extend into the jack receptacle 222 as best seen in FIGS. 10 and 13.

In assembly, the contacts 220 are preferably preformed and the configurations shown in FIGS. 10 and 13. It will be understood that unlike the embodiment of FIGS. 1–10 where each contact 20 has either one of only two configurations depending on whether it is received in a shorter or longer one of the grooves 122, each contact 220 will differ from another depending on both the particular connecting groove 312 as well as the particular groove 280*a*–280*h* in which it is received, the latter determining the angle the oblique portion 220*d* forms with the adjoining contact portions. Each contact 220 is fitted in its respective grooves 274, 278, 280, 312 and 310 or 311 in the intermediate part 218. The contact portion 220*g* of each contact lies over the top face 316 of the contact backing portion 314 with contact portion 220*h* extending rearwardly beneath contact backing face 318 so that its free end is received in a respective slot formed between adjacent walls 320 as seen in FIG. 13. The intermediate part 218 and associated contacts 220 are then assembled to the front part by inserting the contact backing portion 314 through the rear of opening 240 of front part 214 with each contact portion 220*g* being received in a respective downwardly opening groove 252 of the face 254 of cavity 238 to fix contact portion 220*g* in place. At the same time guide fingers 256 are received in guide openings 290 and latching member 258 is received in opening 286 to lock over the shoulder 288 (FIG. 13) to fix the front and intermediate parts to each other. The rear part 216 is then applied to the assembly by passing latching members 332 into slots 284 to lock the rear part to the existing assembly. The fingers 330 of rear part 216 interdigitate with the fingers 300 of intermediate part 218. The inner faces of top and rear walls 326 and 328 overlie the contact portion receiving grooves 274, 278 and 280, a lower face region of the inner face of rear wall 328 overlying grooves 310, while the forward face of each finger 330 overlies each of the grooves 311. In this manner the contacts 220 are fully supported and enclosed within the housing 212.

In operation, a modular plug connector having flat contact terminals 224 is inserted into jack receptacle 222 and as seen in FIG. 13, each terminal 224 engages a contact portion 220*h* of a respective contact to flex it to the position shown by solid lines in FIG. 13. The free ends of contact portions 220*h* are precisely positioned by being captured within the slots defined between walls 320. Moreover, it is not possible to permanently deform the contacts since undue deformation is prevented by the presence of backing surface 318.

Although it is not possible to form any one part of the jack housing 212 of a conductive shielding material since a contact engages all of the three housing parts, it will be understood by those skilled in the art that it is possible to provide a grounded contact at a side of the jack receptacle to ground a shield terminating contact pin of the modular plug connector in the same manner as described above in the embodiment of FIGS. 1–10.

Obviously, numerous modifications and variations of the present invention are possible in the light of the above teachings. It is therefore to be understood that the invention may be practiced within the scope of the claims in a manner different than as specifically disclosed herein.

What is claimed is:

1. A jack for a modular plug connector, comprising:

a jack housing formed of a plurality of jack parts lockingly interfit with each other to define an opening and an elongated receptacle for receiving a modular plug connector inserted through said opening;

said plurality of jack parts including a unitary front part formed of electrically conductive material which provides shielding against electromagnetic and radio frequency radiation, said front part having a frame portion including at least top and side walls extending rearwardly from said opening through which the modular plug connector is inserted, each of said top and said walls having a longitudinally extending inner surface at least a substantial portion of which bounds said plug receptacle such that a substantial portion of the length of said elongated jack receptacle is bounded on at least three sides by the electrically conductive material of said front part; and a plurality of jack contacts, each contact having a first pin portion including a pin part extending externally of the housing and a second portion extending into said receptacle adapted to be engaged by a contact of a modular plug connector.

2. The jack of claim 1 wherein said jack housing is formed of said front part, a bottom part and a rear part.

3. The jack of claim 2 further including post means provided on said bottom part for fastening said jack to a printed circuit board.

4. The jack of claim 2 wherein said bottom part has a plurality of parallel grooves formed therein, each contact having a portion situated in a respective groove, and wherein said rear part has a substantially planar face overlying said contact portion receiving grooves to fix said contact portions in said grooves.

5. The jack of claim 4 wherein said contact portion receiving grooves are formed in a top face of said bottom part and said planar face comprises a bottom face of said rear part.

6. The jack of claim 4 wherein said rear part includes a contact backing portion including an upper obliquely extending contact backing surface and a bottom face constituting said planar face which overlies said contact portion receiving grooves.

7. The jack of claim 5 wherein one end of each of said contact portion receiving grooves opens onto a front face of said bottom part and another end terminates in a bore formed through said bottom part having an axis extending substantially perpendicularly to said groove.

8. The jack of claim 7 wherein said rear and bottom parts include means for fixing said front and bottom parts to each other.

9. The jack of claim 8 wherein said bottom part includes a bottom portion having a pair of latching members and a pair of opposed side edge regions, said bottom part further including a pair of rail portions provided at respective ones of said opposed side edge regions, said rail portions including rearwardly opening channels formed therein, and wherein said rear part includes a pair of ribs adapted to be received in respective ones of said channels and a post member adapted to be engaged by said pair of latching members.

10. The jack of claim 2 wherein said rear part includes a block portion having a front face and a rear face, a cavity being formed in said block portion opening onto its front face in which said front part frame portion is received, said rear part further including a contact backing portion projecting forwardly from said block portion and having a bottom face and an upper obliquely extending contact backing surface partially defining said jack receptacle together with said front part frame portion; and wherein said bottom part includes a bottom portion having a top face and a front face, a plurality of grooves formed in said bottom portion top face, each contact having a portion situated in a respective groove, one end of each of said contact portion receiving grooves opening onto said front face of said bottom portion and another end terminating in a bore formed through said bottom part having an axis extending substantially perpendicularly to said grooves, through which said first contact portion passes, and wherein said bottom planar face of said contact backing portion of said rear part overlies said contact portion receiving grooves, and wherein said second portion of each of said contacts extends into said jack receptacle defined by said top and side walls of said frame portion of said front part and said contact backing surface of said rear part.

11. The jack of claim 2 wherein said front part frame portion includes a rear wall and wherein a plurality of slots are formed in said rear part, each slot being formed by a pair of opposed walls of said rear part and a bottom face of said frame portion rear wall and wherein an end portion of each of said contact second portions is captured in a respective one of said slots.

12. The jack of claim 2 wherein said front part frame portion includes a rear wall and wherein a plurality of slots are formed in said rear part, each slot being formed by a pair of opposed walls of said rear part and a bottom face of said frame portion rear wall, and wherein an end portion of each of said contact second portions is captured in a respective one of said slots, and wherein electrical insulation means are provided over said bottom face of said frame portion rear wall for isolating said contact end portions from said bottom face of said frame portion rear wall.

13. The jack of claim 1 wherein said contacts are electrically isolated from said front part.

14. The jack of claim 10 wherein said bottom portion of said bottom part has a pair of latching members projecting rearwardly therefrom and a pair of opposed side edge regions, and further including rail portions provided at respective side edge regions of said bottom portion, each of said rail portions including a forwardly and a rearwardly opening channel, and wherein said rear part includes a pair of ribs adapted to be received in respective ones of said rearwardly opening channels and a post member adapted to be engaged by said pair of latching members.

15. The jack of claim 14 wherein said rear part has at least one latching member projecting forwardly from said front face thereof, and wherein said front part includes at least one slot formed therein adapted to receive said at least one latching member and a pair of ribs adapted to be received in respective ones of said forwardly opening channels.

16. The jack of claim 2 adapted for use with a modular plug connector having radiation shield terminating contact means and wherein said inner surface of one of said top and side walls of said frame portion of said front part formed of electrically conductive material is adapted to be engaged by said shield terminating contact means upon insertion of said modular plug connector to ground the shield and prevent electrostatic arcing.

17. A jack for a modular plug connector which terminates a cord constituted by a plurality of insulated conductors surrounded by a sheath of conductive material constituting a shield for suppressing radiation of electromagnetic and radio frequency interference-causing signals from and to the conductors, the modular plug connector including a dielectric housing having a cord-receiving aperture communicating with an internal cord-receiving cavity having a conductor-receiving portion in which the cord conductors are situated, a plurality of flat contact terminals having conductor engaging portions and contact edges, each flat contact terminal being situated in a respective slot in the housing aligned with a respective conductor with its engaging portion contacting said respective conductors to electrically engage the same and wherein the contact edges of the flat contact terminals are exposed at a common side wall of the housing, and shield terminating contact means electrically engaging said shield, the shield terminating contact means including an externally exposed portion situated at the exterior surface of at least one of the walls of the connector housing, the jack comprising:

a jack housing having a receptacle for the modular plug connector, an array of contacts mounted in said jack housing having portions situated within said connector receptacle adapted to be electrically engaged by contact edges of respective flat contact terminals upon insertion of the modular plug connector into said connector receptacle, at least a portion of said jack housing is formed of a material which attenuates electromagnetic and radio frequency interference-causing signals passing therethrough so that the jack housing constitutes an EMI/RFI shield for the modular plug connector, and wherein said jack housing portion is adapted to be electrically engaged by said externally exposed portion of said shield terminating contact means upon insertion of the modular plug connector into said connector receptacle.

* * * * *